US009234708B2

(12) United States Patent
Krohn et al.

(10) Patent No.: US 9,234,708 B2
(45) Date of Patent: Jan. 12, 2016

(54) HEAT EXCHANGER FOLDED FROM A SINGLE METAL SHEET AND HAVING TWO SEPARATE CHAMBERS

(75) Inventors: Daniel Krohn, Sauerlach (DE); Simon Jocham, München (DE)

(73) Assignee: NFT Nanofiltertechnik Gesellschaft mit beschränkter Haftung, Bad Homburg v.d.H. (DE)

( * ) Notice: Subject to any disclaimer, the term of this patent is extended or adjusted under 35 U.S.C. 154(b) by 218 days.

(21) Appl. No.: 13/882,521

(22) PCT Filed: Nov. 3, 2011

(86) PCT No.: PCT/EP2011/005549

§ 371 (c)(1), (2), (4) Date: Apr. 30, 2013

(87) PCT Pub. No.: WO2012/062430

PCT Pub. Date: May 18, 2012

(65) Prior Publication Data

US 2013/0213622 A1 Aug. 22, 2013

(30) Foreign Application Priority Data

Nov. 8, 2010 (DE) ..... 10 2010 050 519

(51) Int. Cl.

| | |
|---|---|
| ***F28D 15/00*** | (2006.01) |
| ***F28D 9/00*** | (2006.01) |
| ***F28F 3/02*** | (2006.01) |

(Continued)

(52) U.S. Cl.

CPC ..... *F28D 15/00* (2013.01); *F28D 9/0025* (2013.01); *F28F 3/027* (2013.01); *F28F 9/00* (2013.01); *B21D 22/027* (2013.01); *Y10T 29/4935* (2015.01)

(58) Field of Classification Search

CPC ..... F28D 15/00; F28D 9/0025; F28D 1/0391; F28D 7/1684; F28F 3/027; F28F 9/00; F28F 3/025; Y10T 29/4935; B21D 53/04; F24F 12/001; F24F 12/006

See application file for complete search history.

(56) References Cited

U.S. PATENT DOCUMENTS

| | | | |
|---|---|---|---|
| 2,576,213 | A | 11/1951 | Chausson |
| 3,829,945 | A | 8/1974 | Kanzler et al. |

(Continued)

FOREIGN PATENT DOCUMENTS

| | | |
|---|---|---|
| DE | 1501663 A1 | 6/1969 |
| DE | 3328229 | 2/1985 |

(Continued)

OTHER PUBLICATIONS

International Search Report, PCT/EP2011/005549, dated Mar. 1, 2012, 7 pages.

(Continued)

*Primary Examiner* — David Bryant
*Assistant Examiner* — Jun Yoo
(74) *Attorney, Agent, or Firm* — Senniger Powers LLP

(57) ABSTRACT

A heat exchanger with a housing comprising two chambers separated by a partition plate, with each chamber comprising an inlet opening and an outlet opening for fluids. The housing and the partition plate are formed from a single metal sheet, the partition plate is formed from a middle area of the metal sheet, comprising a plurality of ribs and channels running alternately in parallel, and the housing is formed from side areas of the metal sheet which are folded along bend lines.

8 Claims, 9 Drawing Sheets

(51) Int. Cl.
*F28F 9/00* (2006.01)
*B21D 22/02* (2006.01)

(56) References Cited

U.S. PATENT DOCUMENTS

| | | | | |
|---|---|---|---|---|
| 4,391,321 | A | 7/1983 | Thunberg | |
| 4,926,935 | A | 5/1990 | Haushalter | |
| 5,372,187 | A | 12/1994 | Haushalter | |
| 6,032,730 | A * | 3/2000 | Akita et al. | 165/166 |
| 6,802,365 | B2 * | 10/2004 | Huguet et al. | 165/166 |
| 7,303,002 | B2 | 12/2007 | Usui et al. | |
| 7,458,416 | B2 | 12/2008 | Hofmann | |
| 2002/0170706 | A1 | 11/2002 | Hosokawa et al. | |
| 2004/0200605 | A1 | 10/2004 | Yoshida et al. | |
| 2009/0101313 | A1 | 4/2009 | Hofmann | |
| 2009/0266127 | A1 | 10/2009 | Carle et al. | |
| 2011/0072835 | A1 | 3/2011 | Nicolai et al. | |
| 2011/0192173 | A1 | 8/2011 | Walter et al. | |

FOREIGN PATENT DOCUMENTS

| | | |
|---|---|---|
| DE | 243088 | 2/1987 |
| DE | 102006041270 A1 | 3/2008 |
| DE | 102006052581 A1 | 5/2008 |
| GB | 2059567 | 4/1981 |
| JP | 2003185365 | 7/2003 |

OTHER PUBLICATIONS

Abstract of JP2003185365; Jul. 3, 2003.

* cited by examiner

HEAT EXCHANGER FOLDED FROM A SINGLE METAL SHEET AND HAVING TWO SEPARATE CHAMBERS

REFERENCE TO RELATED APPLICATIONS

This application is a PCT national stage application based PCT/EP2011/005549 filed Nov. 3, 2011 and claims priority to German application 10 2010 050 519.6 filed Nov. 8, 2010, the entire disclosures of which are incorporated by reference.

FIELD OF THE INVENTION

The invention relates to a heat exchanger according to the preamble of claim 1 as well as a method of manufacturing a heat exchanger.

BACKGROUND OF THE INVENTION

Such a heat exchanger is known from DE 20 2008 003 516 U1. It shows a cooling device for electronic components with plate on both sides provided with heat exchanger elements along the surface of which two separate air flow paths are located of which one is carrying external air and the other is carrying internal air. The cooling device has two inlets located in one plane which are in fluid connection. The two chambers are in fluid connection with ducts on the upper and lower side of the plate with the plate comprising at least one Peltier element.

Said cooling device is a compact device which can be inserted into a switch cabinet as a cassette and draws in cool external air through slots or openings of a switch cabinet. It is formed as an insertion element which is also adapted to standard switch cabinets with 19 inch rails.

From U.S. Pat. No. 4,926,935 A a heat exchanger is known where a thin-walled metal sheet is formed such that a plurality of ribs running in parallel, with flat upper and lower side, results. Subsequently, the metal sheet is formed transversely to the longitudinal direction such that their upper and lower sides each form a closed plane with abutting edges being connected with each other, for example by soldering. Thus, triangular ducts, separate from each other, are formed between the flat upper and lower sides. Said design is supposed to avoid the necessity of a base plate from which cooling ribs protrude.

The manufacture of ribbed plates can, for example, be taken from US 2009/0266127 A1.

U.S. Pat. No. 5,372,187 shows a double corrugated heat exchanger made from a continuous metal sheet. Due to the double corrugation, the effective surface area is supposed to be increased.

DE 102 33 736 B3 shows a heat exchanger with a substrate having a plurality of regularly positioned ducts extending through the substrate as well as bars protruding from an upper side of the substrate, the height of which corresponds at maximum to half of the length of the ducts in flow direction. A directed fluid flow runs tangentially to both sides of the substrate.

The bars are directed transversely to the flow direction and serve as a flow obstacle for producing turbulence zones which improve a heat transfer.

DE 10 2008 013 850 B3 shows an air-conditioning system for components located in a switch cabinet. The air-conditioning system comprises three ducts. The first duct serves as an external duct. A partition wall separates the external duct from a center duct, and a Peltier element provided on both sides with heat exchanger elements separates the center duct from an internal duct. By switchable flaps on the ends of the ducts, a first fluid can be guided through the external duct in a first operating mode and in a second operating mode through the center duct, with a second fluid in the first operating mode flowing through the center duct and in the second operating mode through the internal duct. In one operating mode an air/heat exchange occurs and in the second operating mode active cooling by the Peltier element occurs.

SUMMARY OF THE INVENTION

It is the object of the invention to improve the heat exchanger mentioned above such that it can be manufactured with a lower weight in a simple and cost-effective manner. Moreover, a method of manufacturing said heat exchanger shall be specified which, with low material usage, requires only a few working steps.

This object is solved by the features mentioned in claims 1 and 5.

BRIEF DESCRIPTION OF THE FIGURES

The invention will subsequently be described in detail in connection with the drawings by means of an embodiment as follows.

DETAILED DESCRIPTION OF PREFERRED EMBODIMENTS

Figure 1:
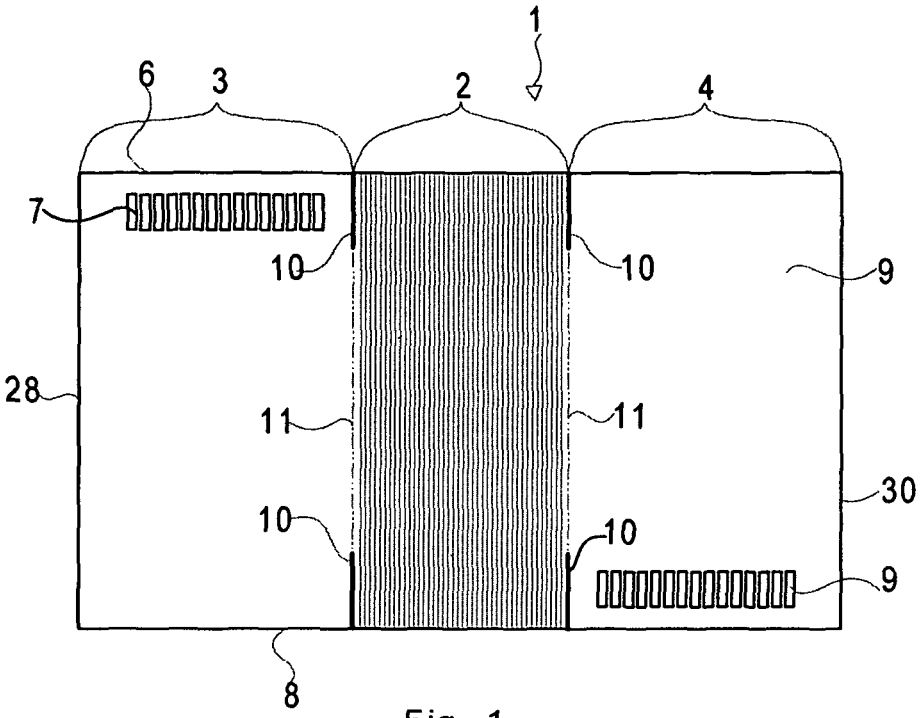
FIG. 1 shows a plan view of a metal sheet, which is used for manufacture of the heat exchanger, after some processing steps.

FIG. 1 shows a plan view of a metal sheet 1 comprising a formed middle area 2 and flat side areas 3 and 4 adjacent on both sides. In the middle area the metal sheet is shaped such that it comprises a plurality of ribs 5 running in parallel to each other, which are, for example, produced by a rib forming machine according to US 2009/0266127 A1. The ribs 5 may have different shapes as will still be explained further in connection with FIG. 12. Generally, the ribs and their geometry can be produced by standardized bending, folding, rebating, rolling and related forming processes, which permit to realize the bends for producing the ribs 5 only in the provided middle area 2, and do not affect the remaining space of the side areas 3 and 4.

The flat side area 3 near a first edge 6 has a plurality of parallel recesses 7 which are, for example, produced by stamping or laser cutting. Similarly, the side area 4 close to the edge 8 has corresponding recesses 9 which are in principal located in double mirror symmetry to the recesses 7. The recesses 7 and 9 serve as an air inlet and/or air outlet in the finished heat exchanger.

Moreover, in the transition area between the middle area 2 and the two side areas 3 close to both edges 6 and 8 each a cut 10 is visible. A thin dashed line on both sides of the middle area 2 indicates a bend line 11 along which the two side areas 3 and 4 opposite the middle area 2 are bent later.

Figure 4:
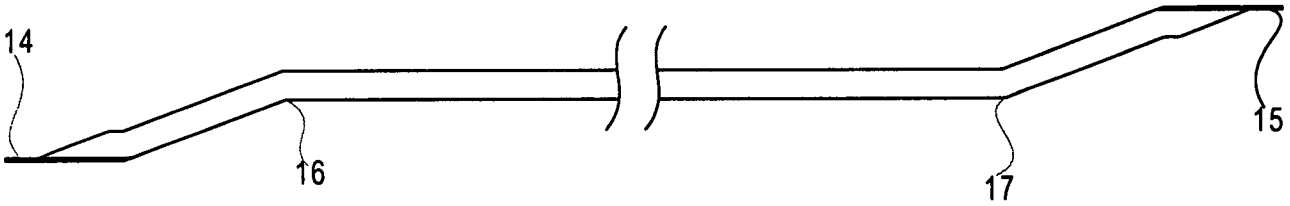
FIG. 4 shows a side view of the metal sheet after further forming steps.

The length of the four cuts 10 is determined by the geometric relations and is explained in connection with FIGS. 4 and 5.

The middle area 2 forms the separation and heat exchange surface on the finished heat exchanger. Its structure is such that the surface is maximized and has a minimum drag coefficient in case of forced overflow.

The material thickness of the metal sheet 1 depends on the material selected, which might be, for example, aluminium, copper or other material conducting heat well, as well as on the overall stability which is required for the respective intended purpose.

Figure 2:
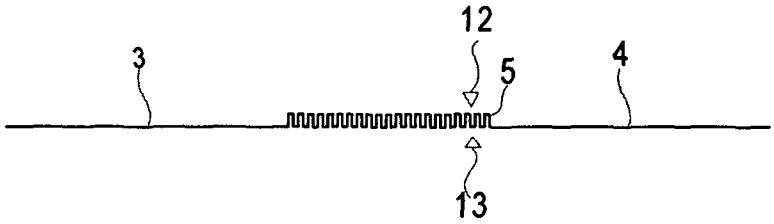
FIG. 2 shows a front view of the metal sheet of FIG. 1.
Figure 3:
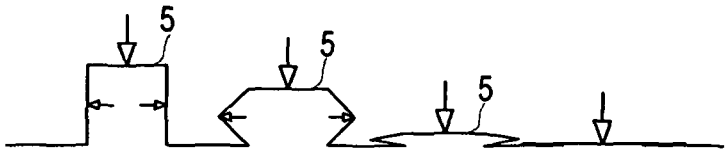
FIG. 3 shows sections of metal sheet ends of FIG. 1 for explanation of the shaping steps.

The metal sheet 1 formed according to FIGS. 1 and 2, is bent and shaped in further working steps. In one working step the ends of the ribs 5 near the edges 6 and 8, according to FIG. 3 and the directions of force indicated by arrows, are pressed together in such a way that they are flatly pressed together, as is shown at the far right in FIG. 3. These pressed end areas are identified in FIGS. 14 and 15 with reference numerals 14 and 15.

In another working step the middle area is each bent close to the edges 6 and 8 on bending points 16 and 17. The two side areas 3 and 4 are not deformed in the process. As a result, the length of the cuts 10 is selected such that they just extend up to the bending points 16 and 17.

Figure 5:
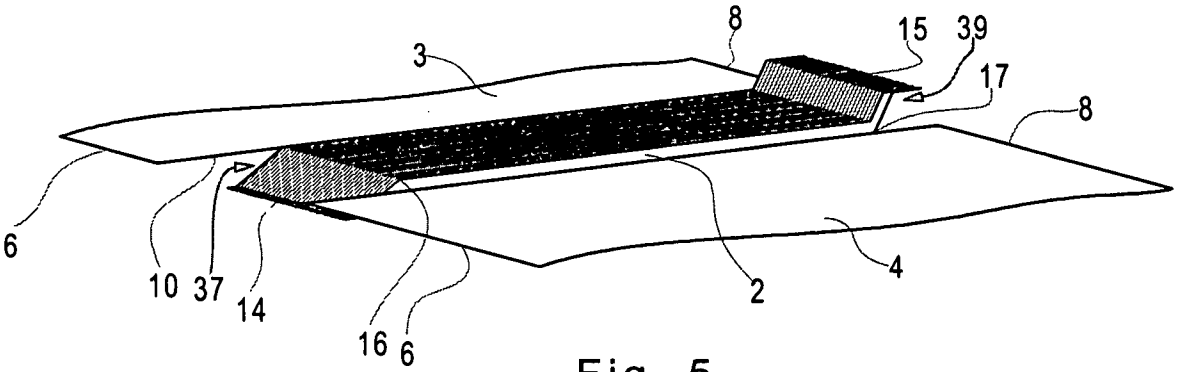
FIG. 5 shows a perspective view of the metal sheet after the forming steps of FIG. 4.
Figure 6:
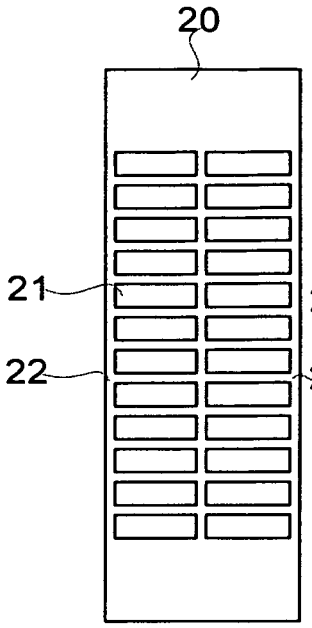
FIG. 6 shows a plan view of a second metal sheet which is used in the manufacture of the heat exchanger.
Figure 7:
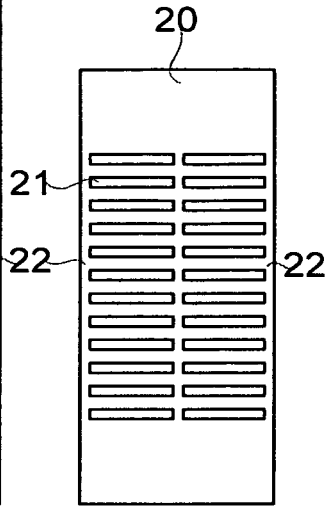
FIG. 7 shows a plan view of the metal sheet of FIG. 6 after a forming.

After these working steps the metal sheet 1 has the shape shown in the perspective view of FIG. 5 with the two side areas 3 and 4 still being unshaped and flat.

FIGS. 6 to 9 show a second metal sheet 20 which shall form a grid support in the end. The metal sheet 20 is likewise a flat metal sheet which is preferably made from the same material as the metal sheet 1. It has a plurality of stamped out or cut out windows 21 which are preferably rectangular.

Figure 8:
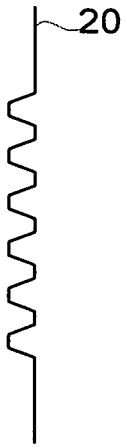
FIG. 8 shows a side view of the metal sheet of FIG. 7.

In one processing step the second metal sheet 20 is bent according to the side view of FIG. 8 such that the windows 21 protrude obliquely or vertically from the metal sheet plane and are surrounded by bars 22 and 23 all around. The bars 22 and 23 act fluidically as flow obstacles which shall create turbulence of a flowing medium such as, for example, air which improves heat transfer.

Figure 9:
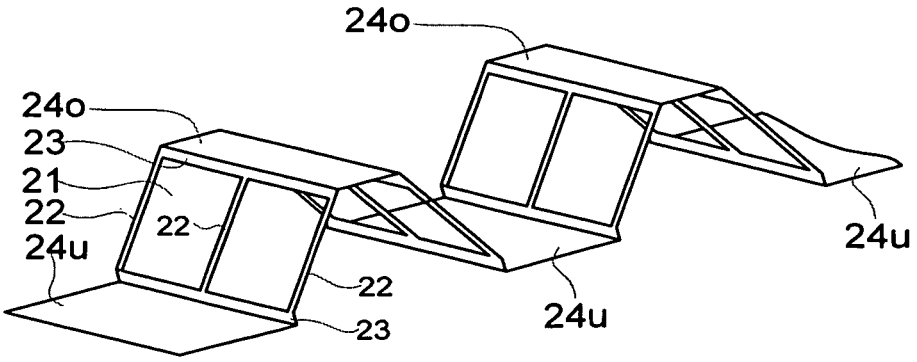
FIG. 9 shows a perspective view of the metal sheet of FIGS. 7 and 8.

The grid support formed from metal sheet 20 according to FIGS. 8 and 9 is produced twice. One grid support is fitted to the upper side 12 and the other on the lower side 13 of the formed middle area 2 according to the semi-finished material shown in FIG. 5, with flat, closed lower surfaces 24*u* being connected with flat surfaces of the ribs 5. Flat upper surfaces 24*o* of the metal sheet 20 are later brought into contact with the side areas 3 or 4, and preferably connected. This may occur by gluing, soldering, welding or any other known joining method, with a good heat transfer in these points being desirable.

Figure 10:
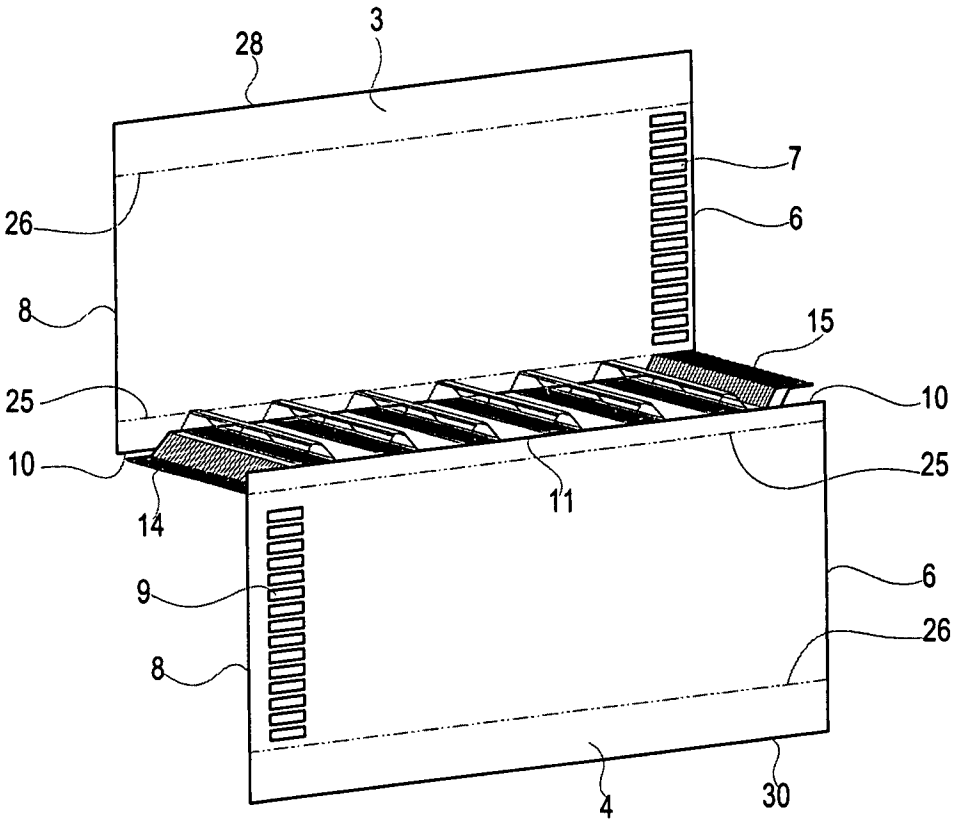
FIG. 10 shows a perspective view of the heat exchanger on which the two metal sheets of FIGS. 5 and 9 are connected with each other.
Figure 11:
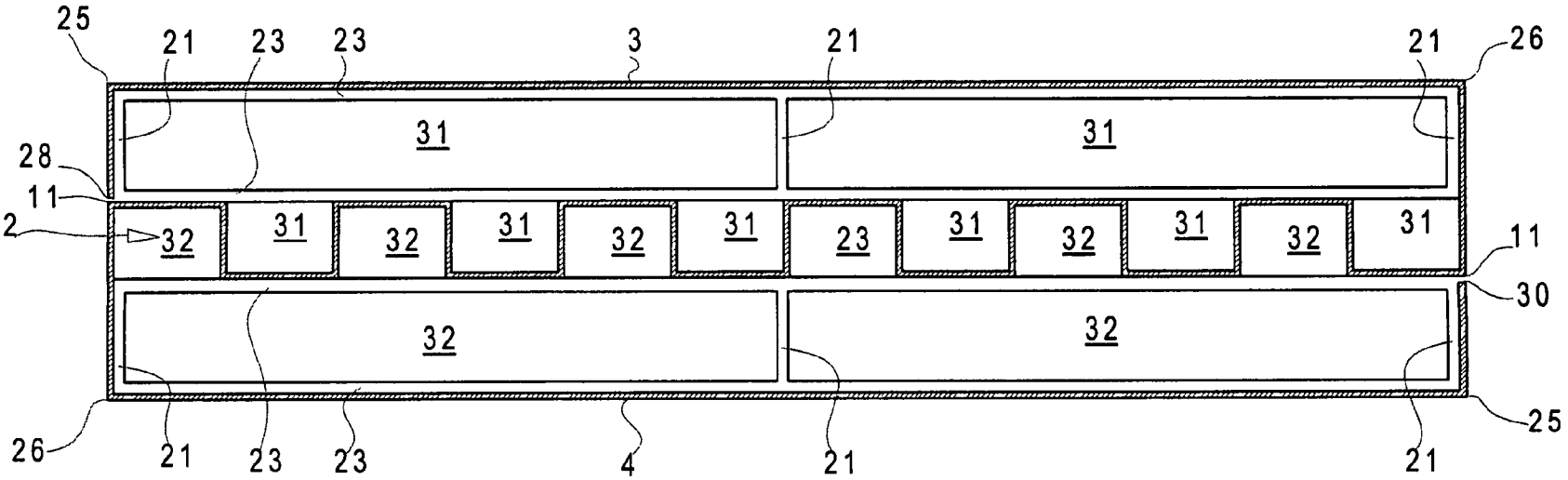
FIG. 11 shows a cross-section of the fully assembled heat exchanger according to an embodiment of the invention.

After the grid supports have been fitted to the middle area 2, the two side areas 3 and 4 are bent opposite to each other according to the bend lines 11, 26 and 27 shown in FIG. 10 as dashed lines so that they entirely surround the middle area 2 as can be seen from the sectional view of FIG. 11. The outer side edge 28 of the side area 3 is connected with the inner side edge on the bend line 11 of the side area 4, and the outer side edge 30 of the side area 4 is connected with the inner side edge on the bend line 11 of the side area 3, again, for example, by soldering, so that a tight connection is created vis-à-vis a flowing fluid such as for example air.

Moreover, the pressed end area 14 is connected with the side area 4 and the pressed end area 15 is connected with the side area 3, for example, by soldering, in order that an airtight connection is also created there. On the inclination adjacent to the pressed end area 14 the heat exchanger is open towards the upper side 12. Accordingly, it is open on the inclination towards the lower side 13 adjacent to the end area 15. From the upper side 12 air can escape via opening 7 after flowing through the heat exchanger, and via the openings 9 from the lower side.

FIG. 11 clearly shows again that the heat exchanger has two separate chambers and/or flow paths 31 and 32, which are separate from each other by the shaped middle area 2 of the first metal sheet 1, with the two side areas 3 and 4 forming a housing after a corresponding bending, the stability of which is reinforced by the two supports formed from the second metal sheet 20, which are firmly connected with the middle area 2, and prop the walls of the housing formed by the two side areas 3 and 4. The bars 22 and 23 surrounding the windows 21 form turbulence zones which improve the heat transfer. Due to the firm connection of the bars 23 with the middle area 2, also the supports are thermally coupled with the middle area 2 so that heat is also dissipated from them.

The heat exchanger has two chambers and/or flow paths 31 and 32 entirely separate from each other. The first flow path 31 is open on a front side formed by the edge 6 while its other front side on the edge 8 is closed, since the part of the side area 4, which is connected to the pressed end area 15, forms a tight closure there. An outlet of fluid, such as for example air, occurs in this area through the recesses 9.

In mirror symmetry, the second flow path 32 on the front side of the edge 8 is open and on the front side of the edge 6 closed, since the side area 3 in the area of the edge 6 is connected with the pressed end area 14, with an outlet opening being created in this area by the recesses 7.

The heat exchanger can be used for any cooling media, as for example for air/air, air/water, with a flow being forced through the flow paths 25 and 26 by appropriate means such as fans or pumps. The heat exchanger can be realized as a flat, cassette-type component and, for example, also form a wall of a switch cabinet. It can also be inserted into switch cabinets as a plug-in cassette in order to cool and/or air-condition specific areas.

FIG. 12 shows different versions for the shape of ribs 5 of the middle area 2 of the first metal sheet 1.

Figure 12D:
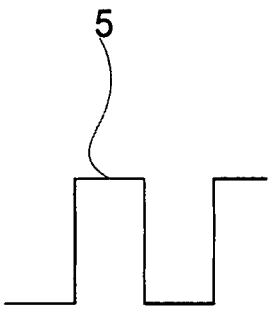
FIG. 12 shows front views of sections of the first metal sheet with different shapings.
Figure 12C:
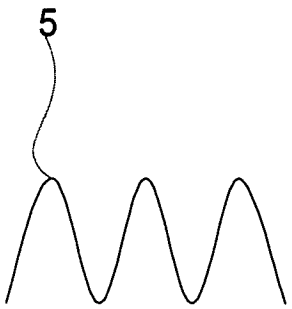
Figure 12B:
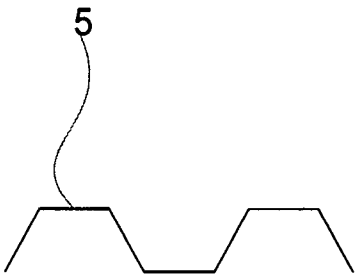
Figure 12A:
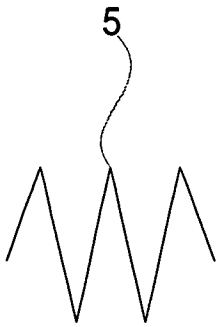

In FIG. 12*a* the ribs are formed according to a triangle function, in FIG. 12*b* as a trapezoid, in FIG. 12*c* as a sine and/or cosine function, and in FIG. 12*d* as an alternating step function which can also be considered as a special form of the trapezoid function. Taking into account the flow resistance, the alternating step function of FIG. 12*d* is considered as a preferred embodiment, as it shows a very low flow resistance at maximum heat exchange surface.

Figure 13:
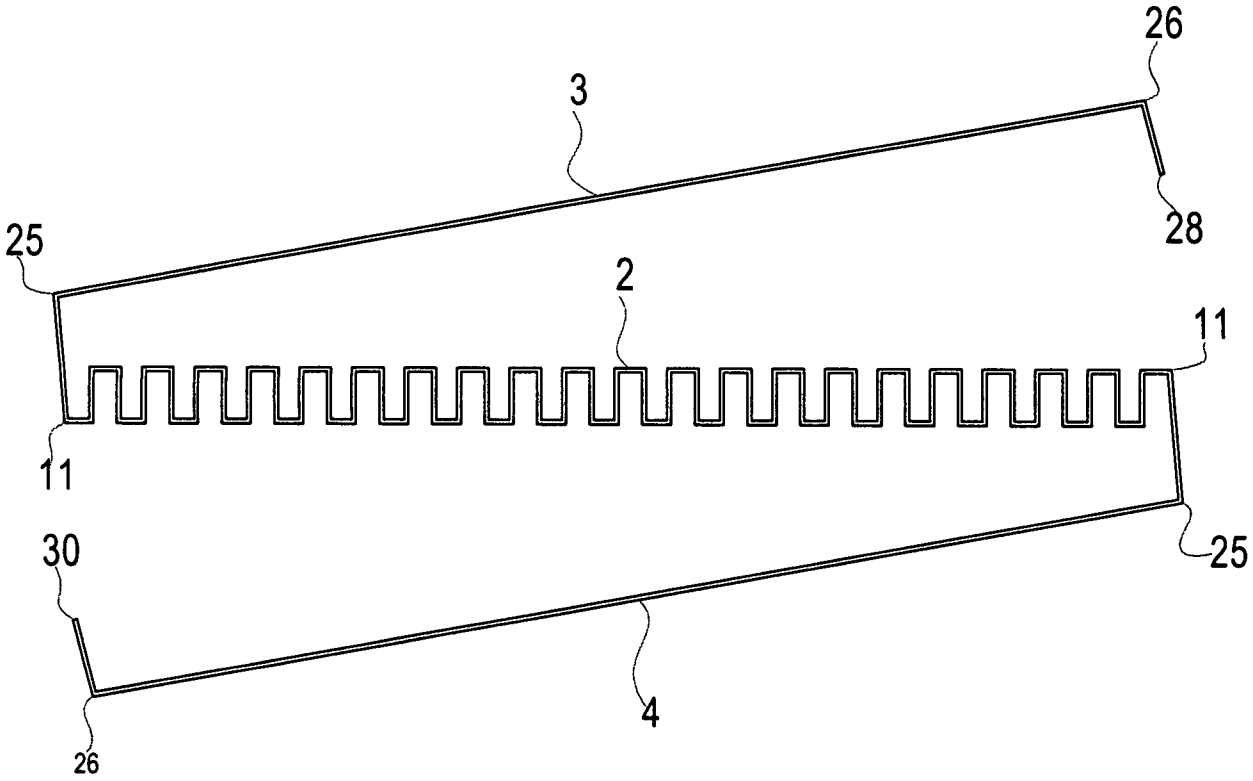
FIG. 13 shows a front view of the heat exchanger for explanation of the forming steps.

FIG. 13 illustrates again the process of bending and/or chamfering of the first metal sheet 1 at bend lines 11, 25 and 26.

Figure 14:
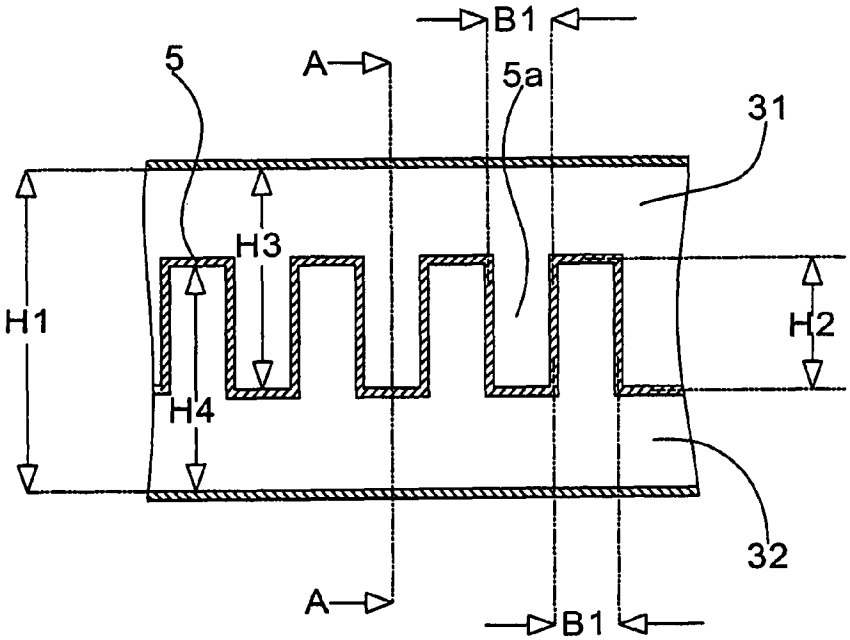
FIG. 14 shows a cross-section through a part of the heat exchanger for explanation of various parameters.

FIG. 14 shows the dimensioning of ribs 5, which, measured from the center of the material, each have a width B1. Since the ribs 5 alternately point in one and in the opposite direction, a rib, pointing in one direction, can also be considered as a groove or channel of the other flow passage. To that effect, ribs and channels preferably have the same width B1. The total height of both passages together is H1, the height of the ribs H2, and the distance of the ribs to the distant passage wall is H3 and/or H4. At symmetrical arrangement H3 and H4 have the same size, which is expedient, when the media flowing through the two passages, are equal, such as for example air/air.

In order to ensure an optimal pressing of the end area 14 and 15, B1 equal to H2 is selected.

Figure 15:
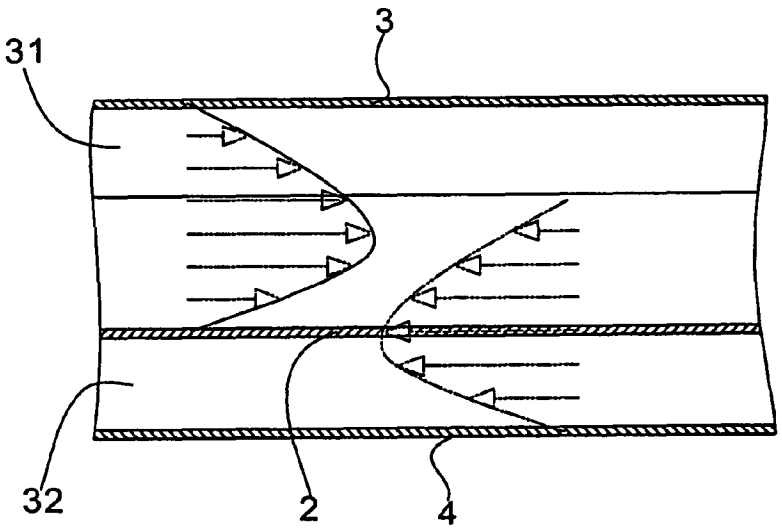
FIG. 15 shows a section along line A-A of FIG. 13.

FIG. 15 shows a section along line A-A of FIG. 14 and in addition shows the flow profile in the two chambers 31 and 32, i.e. the flow velocity as a function of the location. The flow obstacles are omitted here.

Figure 16:
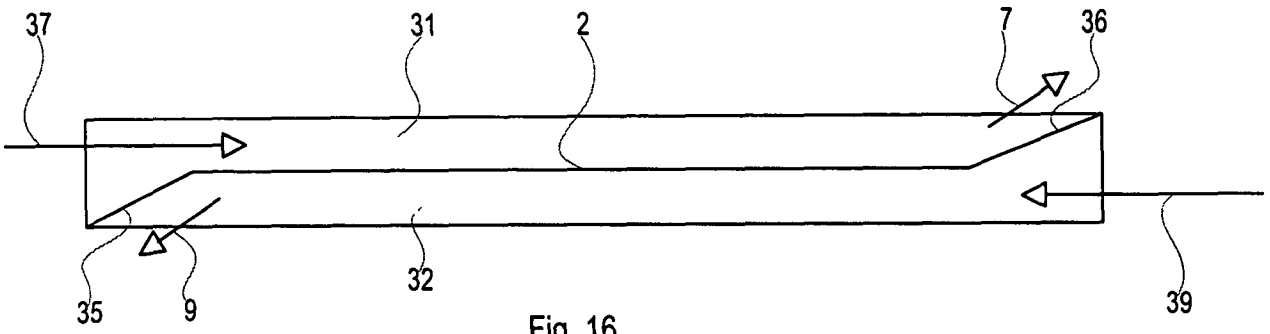
FIG. 16 shows a schematic side view of an arrangement of two heat exchangers according to an embodiment of the invention.
Figure 17:
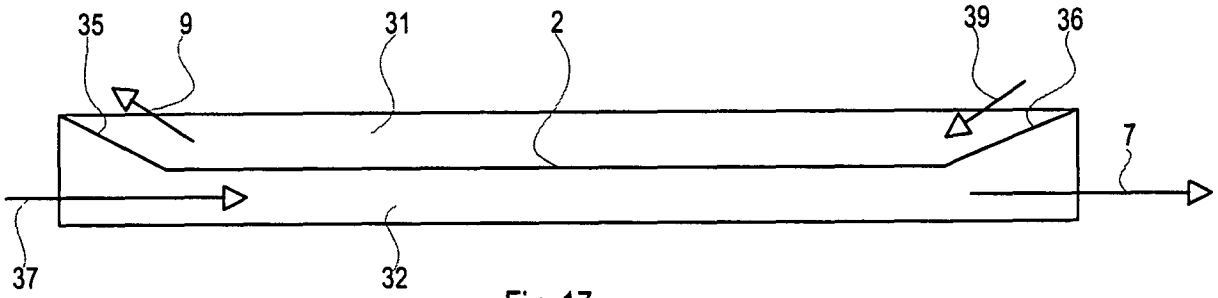
FIG. 17 shows a schematic side view of an arrangement of two heat exchangers according to another embodiment of the invention.

FIGS. 16 and 17 schematically show two versions for bending of the middle area 2. In FIG. 16 the ends of the middle area 2 are bent in opposite directions, as is also shown in FIGS. 5 and 10. In FIG. 17 the two ends, however, are bent in the same direction.

The version in FIG. 16 is particularly suitable for an air/air heat exchanger, whereas the version in FIG. 17 on the one hand permits to produce a passive heat exchanger without fan, which can be realized such that it can replace an entire side wall of a switch cabinet, and nevertheless guarantees the high degree of protection of the cabinet. The version in FIG. 17, with appropriate openings for inlet and outlet, is also suitable for an air/water heat exchanger. By closing the one cavity on both sides, it is possible without great expenditure to use a liquid there instead of gases.

In summary, a thin-walled, three-dimensional hollow body is created by the invention, which can be made from simple metal sheets, and regarding its dimensions by simple manufacturing steps can be flexibly adapted to the desired dimensions, in order to create an optimum heat exchanger even if there is minimum space available. The heat exchanger can be inserted in the desired locations as a cassette.

The invention claimed is:

1. A heat exchanger with a housing comprising two chambers separated by a partition plate, each chamber comprising an inlet opening and an outlet opening for fluids, wherein the housing and the partition plate are formed from a single metal sheet, the partition plate is formed from a middle area of the metal sheet, comprising a plurality of ribs and channels running alternately in parallel, the housing is formed from side areas of the metal sheet which are folded along bend lines, and wherein the ribs and channels at the ends of the middle area are pressed into flat end areas and these end areas are connected to one of the side areas in a fluid-tight manner.

2. The heat exchanger according to claim 1, wherein a grid support made of a second metal sheet is inserted into each of the chambers, which is connected with the middle area of the first metal sheet and the opposite side area of the first metal sheet and has a plurality of windows and bars surrounding said windows.

3. The heat exchanger according to claim 1, wherein the middle area close to its ends comprises bent transition areas leading into the pressed end areas, said transition areas forming one of the inlet or outlet openings.

4. The heat exchanger according to claim 2, wherein the middle area close to its ends comprises bent transition areas leading into the pressed end areas, said transition areas forming one of the inlet or outlet openings.

5. Method of manufacturing a heat exchanger with a housing, comprising two chambers separated by a partition plate, each chamber comprising an inlet opening and an outlet opening for fluids, wherein the housing and the partition plate are formed from a single metal sheet, wherein the partition plate is formed from a middle area of the metal sheet and includes a plurality of ribs and channels running alternately in parallel, and the housing is formed from side areas of the metal sheet, the method comprising the following steps:

providing the flat first metal sheet;

cutting or stamping out openings in the flat metal sheet to form the inlet and outlet openings for the heat exchanger;

shaping of the middle area of the metal sheet to form the plurality of parallel ribs and channels;

pressing the ribs and channels at ends of the middle area into flat end areas;

folding of side areas, adjacent to the middle area on both sides, along parallel bend lines and connecting each of the side areas to a respective one of the flat end areas in a fluid-tight manner to form the housing, and tightly connecting of end edges of the two side areas with edges on the bend lines which are directly adjacent to the middle area.

6. Method according to claim 5, further comprising the following steps:

providing two flat second metal sheets;

cutting or stamping out several windows in the flat metal second sheets such that the windows are surrounded by bars;

multiple folding of the second metal sheets such that the windows and their lateral bars protrude from the plane of the second metal sheets;

connecting the second metal sheets thus formed with the ribs of the middle area of the first metal sheet on its upper and lower side.

7. Method according to claim 5 further comprising the following step:

fluid-tight connecting of said flat end areas with one of the side areas.

8. Method according to claim 7, further comprising bending of the middle area close to its ends.

* * * * *